US005139161A

United States Patent [19]

Long

[11] Patent Number: 5,139,161

[45] Date of Patent: Aug. 18, 1992

[54] AUTOMATIC ACTUATOR FOR COUPLER KNUCKLE-ASSEMBLY OF A RAILWAY PASSENGER CAR

[75] Inventor: Jack R. Long, St. Charles, Ill.

[73] Assignee: National Castings, Inc., Lisle, Ill.

[21] Appl. No.: 691,222

[22] Filed: Apr. 25, 1991

[51] Int. Cl.[5] ..... B61G 3/08

[52] U.S. Cl. ..... 213/124; 213/133; 213/167; 213/212; 213/219

[58] Field of Search ..... 213/115, 119, 120, 124, 213/131, 133, 159, 166, 167, 168, 211, 212, 218, 219

[56] References Cited

U.S. PATENT DOCUMENTS

| | | | |
|---|---|---|---|
| 619,559 | 2/1899 | Garber | 213/159 |
| 1,897,279 | 2/1933 | Richards . | |
| 3,245,553 | 4/1966 | Cope | 213/212 |
| 3,491,899 | 1/1970 | Cope | 213/212 X |
| 3,532,228 | 10/1970 | Beyer | 213/212 |
| 3,972,421 | 8/1976 | DePenti | 213/127 |
| 4,090,615 | 5/1978 | Martin | 213/151 |

FOREIGN PATENT DOCUMENTS

| | | | |
|---|---|---|---|
| 540837 | 5/1957 | Canada | 213/155 |
| 1318466 | 6/1987 | U.S.S.R. | 213/211 |

*Primary Examiner*—Robert J. Oberleitner
*Assistant Examiner*—S. Joseph Morano
*Attorney, Agent, or Firm*—Milton S. Gerstein; Marvin N. Benn

[57] ABSTRACT

A linkage-actuator for the coupler knuckle-assembly of a railway passenger car which is mounted on the coupler head directly adjacent to the knuckle-assembly, which linkage-actuator does not extend along the shank connecting the knuckle-assembly to the car proper, thereby saving considerably on space and weight. The linkage-actuator allows for both manual and pneumatic actuation of the knuckle-assembly. The linkage-actuator for the knuckle-assembly is mounted directly on the coupler head. The rotatable operating rod for placing the knuckle into its lock-set or fully open position is actuated by a pivotal plate mounted on top of the coupler head. One end of the plate is urged into its non-actuated, horizontal position by a spring, while the other end of the plate is connected to an eccentric cam that is coupled to the rotatable actuating rod of the knuckle-assembly. An air-bellows lifts the end of the plate coupled to the eccentric cam which, in turn, rotates the actuating rod, to thereby place the knuckle into its lock-set or fully thrown position.

16 Claims, 6 Drawing Sheets

AUTOMATIC ACTUATOR FOR COUPLER KNUCKLE-ASSEMBLY OF A RAILWAY PASSENGER CAR

BACKGROUND OF THE INVENTION

The present invention is directed to an actuator for the coupler knuckle-connection of a railway passenger car. Conventional railway passenger cars are coupled together by mating couplers on adjoining ends of the passenger cars, which are locked into position by the coupler knuckle. For decoupling the cars, the knuckles are first manually or pneumatically pivoted into the lock-set position, which permits the knuckles to be rotated; after lock-set has been attained, the two cars are then completely decoupled by the relative movement of the two railway cars. During coupling, rotation of the knuckles via the abutting railway cars causes the knuckles to rotate from their completely pivoted open state to the closed, locked state.

Conventional coupler knuckle-assemblies are sometimes actuated by a pneumatic system which is typically controlled from the interior of the passenger car. The pneumatic system uses an air-actuated piston for rotating the operating lever arm of the knuckle-assembly, with the piston being located along the shank of the coupler that connects the coupler knuckle-assembly to the car frame. Such a conventional arrangement provides marginal space for mounting the piston and associated linkage along the connecting shank. However, recent developments have altered the tight-fitting arrangement, in that the conventional shank has been replaced in some cars, especially British railway passenger cars, by a much larger cross-sectional shank that has a hydraulic-cushioning mechanism associated therewith, which helps to prevent injury and deaths during a train accident. Owing to this much larger cross-sectional, hydraulic-cushioning shank, the conventional piston and actuating linkage system can no longer be accommodated along the shank within the available space. The present invention provides a new type of linkage-actuator that is readily accommodated by the new hydraulic-cushioning shanks, and provides a simple and lighter weight arrangement for conventional shanks.

SUMMARY OF THE INVENTION

It is the primary objective of the present invention to provide a linkage-actuator for the knuckle-assembly of a railway passenger car which is mounted directly to the coupler head adjacent to the knuckle-assembly, which linkage-actuator does not extend along the shank connecting the knuckle-assembly to the car proper, thereby saving considerably on space and weight.

It is another objective of the present invention to provide such a linkage-actuator that allows for both manual and pneumatic actuation of the knuckle-assembly.

According to a first embodiment of the invention, the linkage-actuator for the knuckle-assembly is mounted directly adjacent to the knuckle-assembly on the coupler head connecting the knuckle-assembly to the railway car by an integral or separable coupler shank. The rotatable operating rod for placing the knuckle-assembly into its lock-set position is actuated by a pivotal plate mounted on top of the coupler head. One end of the plate is urged into its non-actuated, horizontal position, while the other end of the plate is connected by a flexible chain-link or cable to an eccentric cam that is coupled to the rotatable actuating rod of the knuckle-assembly. An air-bellows lifts the end of the plate coupled to the eccentric cam which, in turn, rotates the actuating rod, to thereby place the knuckle-assembly into its lock-set position. If the coupler is not connected to the coupler of an adjacent car, the mechanism of the invention throws the knuckle to a fully open position, to accommodate subsequent coupling to an adjacent car.

According to the preferred second embodiment of the invention, the pivotal plate is mounted on one lateral side of the coupler head. A torsion spring biasses the eccentric cam in a direction opposite to the direction that an air bellows pivots the plate when the air bellows is actuated. Instead of a chain-link connector coupling the free end of the plate to the eccentric cam, a cable is used. In this embodiment, the entire linkage-actuator coupler is situated on one lateral side of the coupler head, providing additional space-saving capabilities, while also providing a lower cost assembly.

BRIEF DESCRIPTION OF THE DRAWINGS

The invention will be more readily understood with reference to the accompanying drawing, wherein.

DETAILED DESCRIPTION OF THE INVENTION

Figure 1:
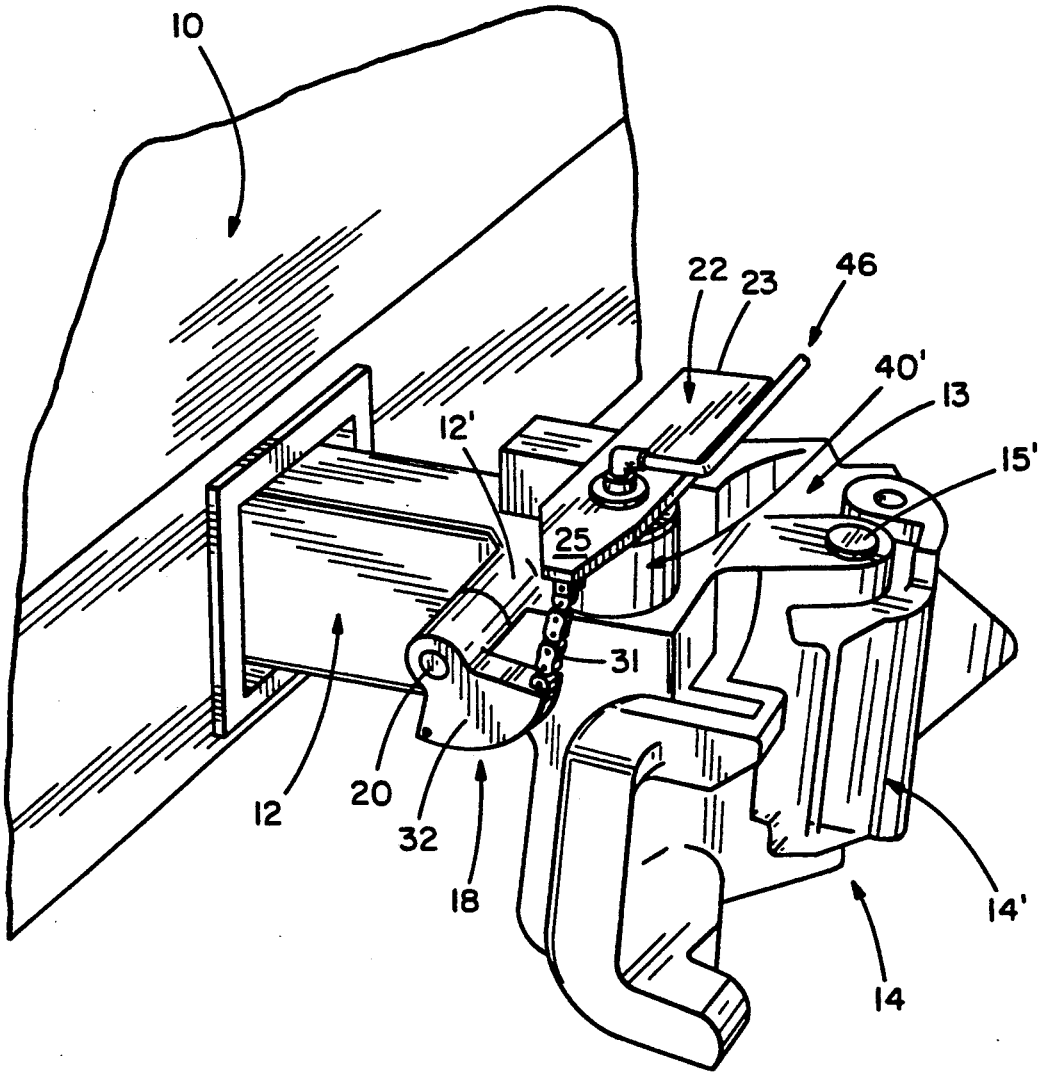
FIG. 1 is a perspective view showing the coupler knuckle linkage-actuator for a railway passenger car according to a first embodiment of the invention.
Figure 2:
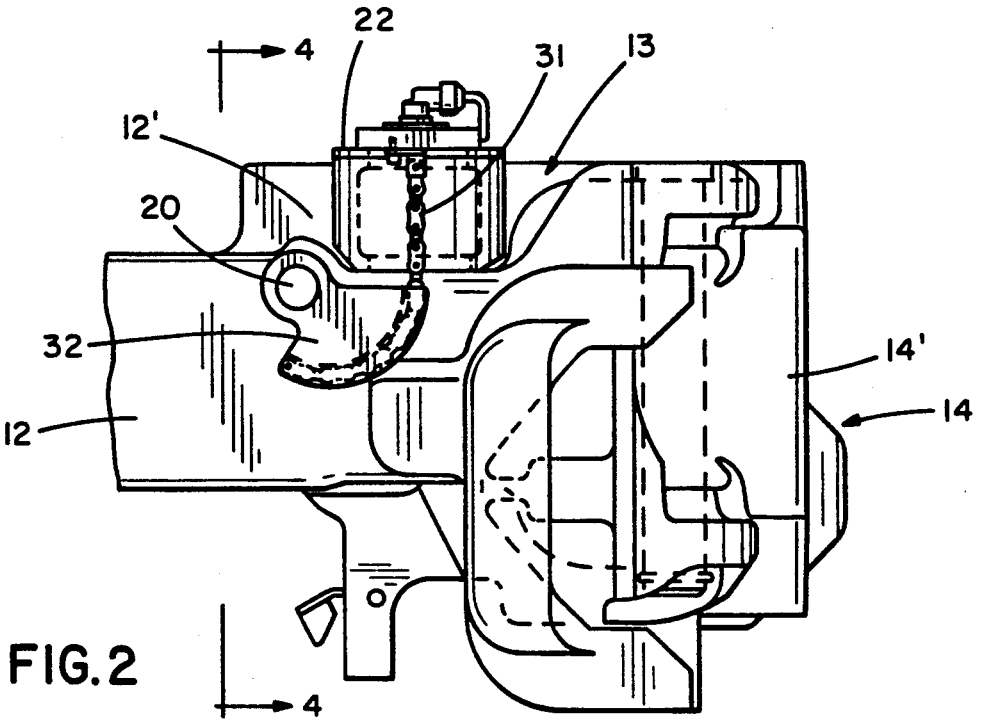
FIG. 2 is a side elevational view thereof, with the linkage-actuator being unactuated, and the knuckle-assembly in its locked state.
Figure 3:
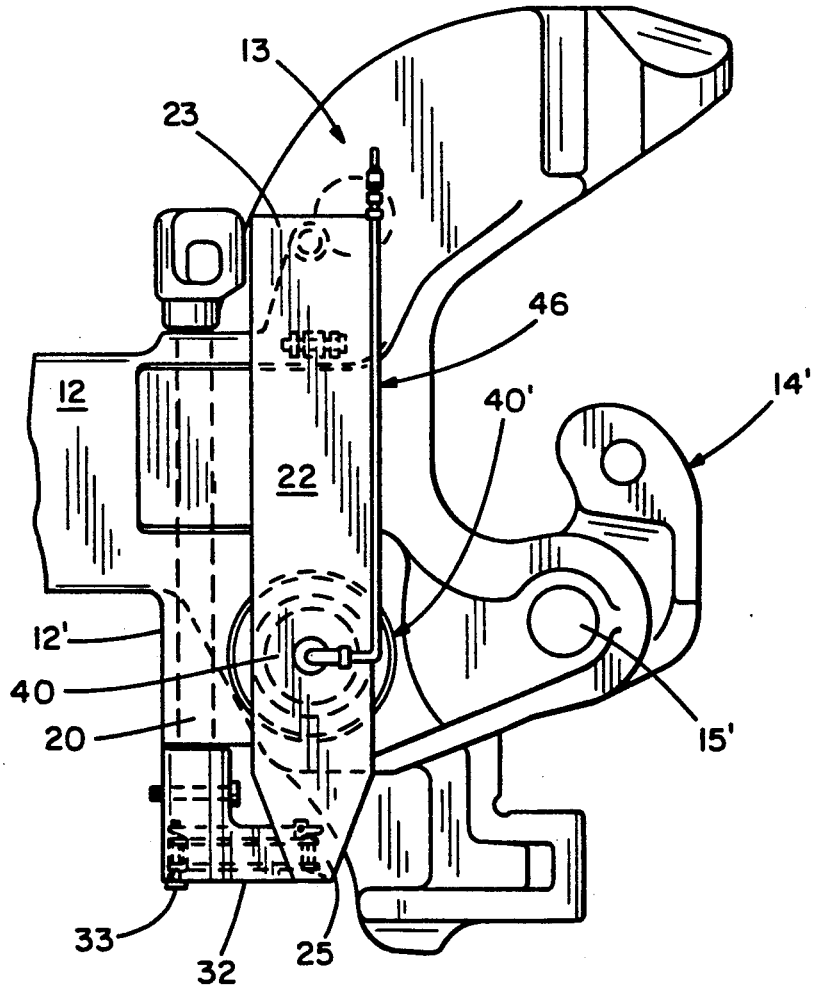
FIG. 3 is a top view thereof, with the knuckle-assembly shown in its closed, locked state.

Referring now to the drawings in greater detail, and for now to FIGS. 1–7, there is shown a first embodiment of the space-saving linkage-actuator for the coupler knuckle-assembly of a railway passenger car according to the invention. A railway passenger car 10 has a conventional shank 12, which shank is connected to a coupler head 13, which coupler head mounts a conventional coupler knuckle-assembly 14 with knuckle 14'. The shank 12 may be a conventional one of narrow width, or it may be a hydraulic-cushioning shank the girth of which is considerably greater. The shank 12 shown in the drawings is of the conventional type, which also benefits from the greater space availability of the novel linkage-actuator 18 of the invention. The linkage-actuator 18 is mounted on the top surface of the coupler head 13, which coupler head is wider than the shank, as can be seen in FIGS. 1 and 3. The interior volume of the coupler head 13 houses the conventional operating parts of the knuckle-assembly 14, forming no part of the present invention, and all of which are well-known. The shank 12 connects to the coupler the knuckle 14' being pivotally mounted via vertical pivot pin 15'. A rotatable operating rod or shaft 20 is connected to the lock lift (not shown) of the knuckle assembly 14 in the conventional manner for effecting rotation thereof for achieving the lock-set and completely uncoupled positions of the knuckle assembly 14 and knuckle 14'. According to the invention, the linkage-actuator 18 effects the rotation of the actuating rod 20, to thus rotate the knuckle-assembly 14 into its lock-set position for the subsequent uncoupling of two cars, or to throw the knuckle to the fully open position for subsequent coupling.

Figure 4:
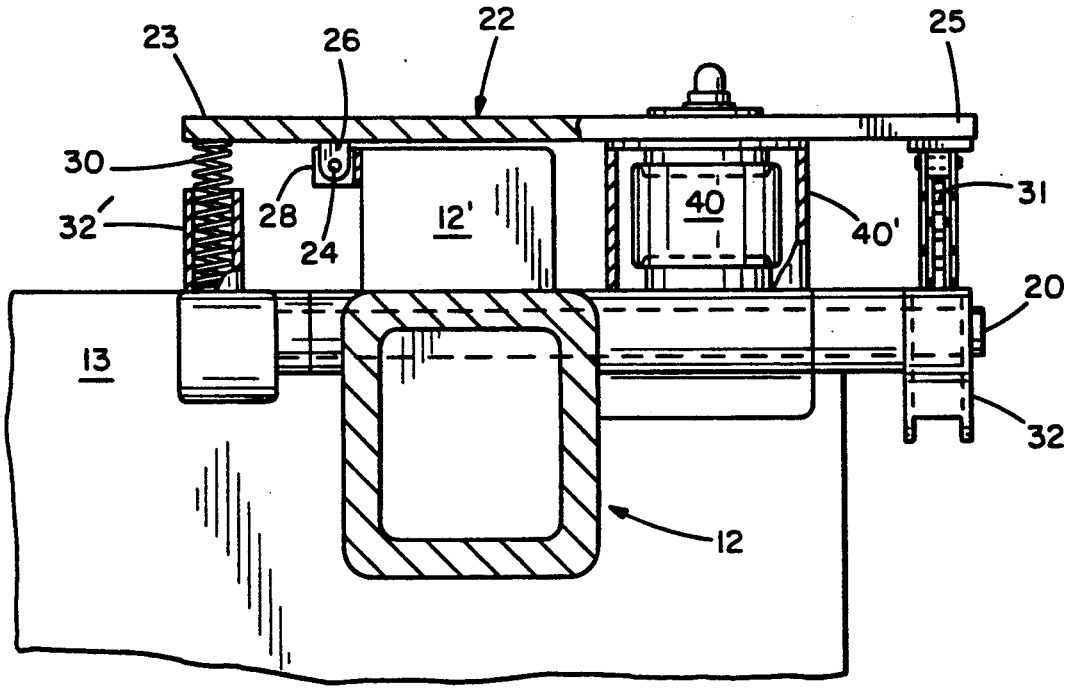
FIG. 4 is a cross-sectional view taken along line 4—4 of FIG. 2.
Figure 5:
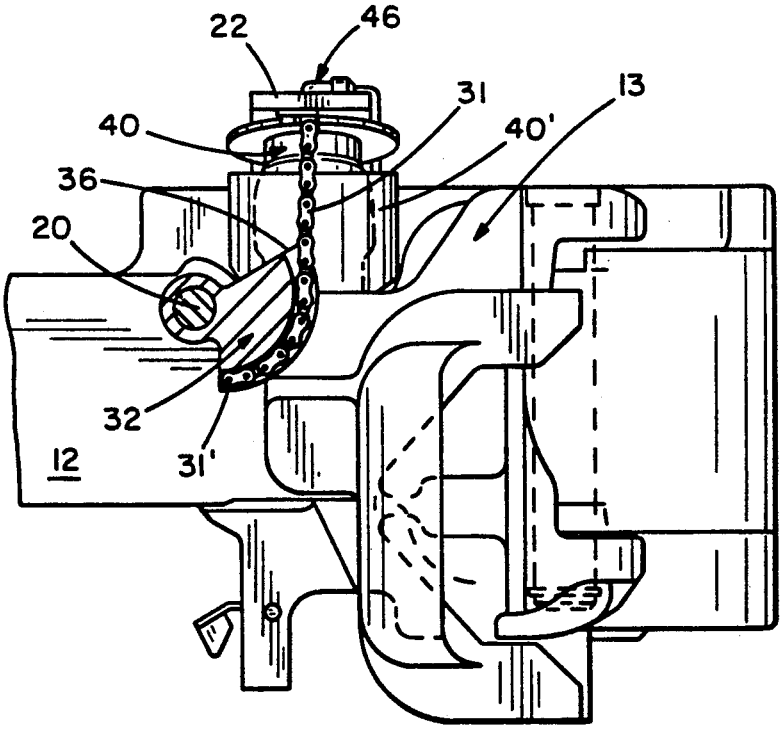
FIG. 5 is a side elevational view showing the linkage-actuator in its actuated state where the knuckle-assembly is positioned in its knuckle open state.
Figure 6:
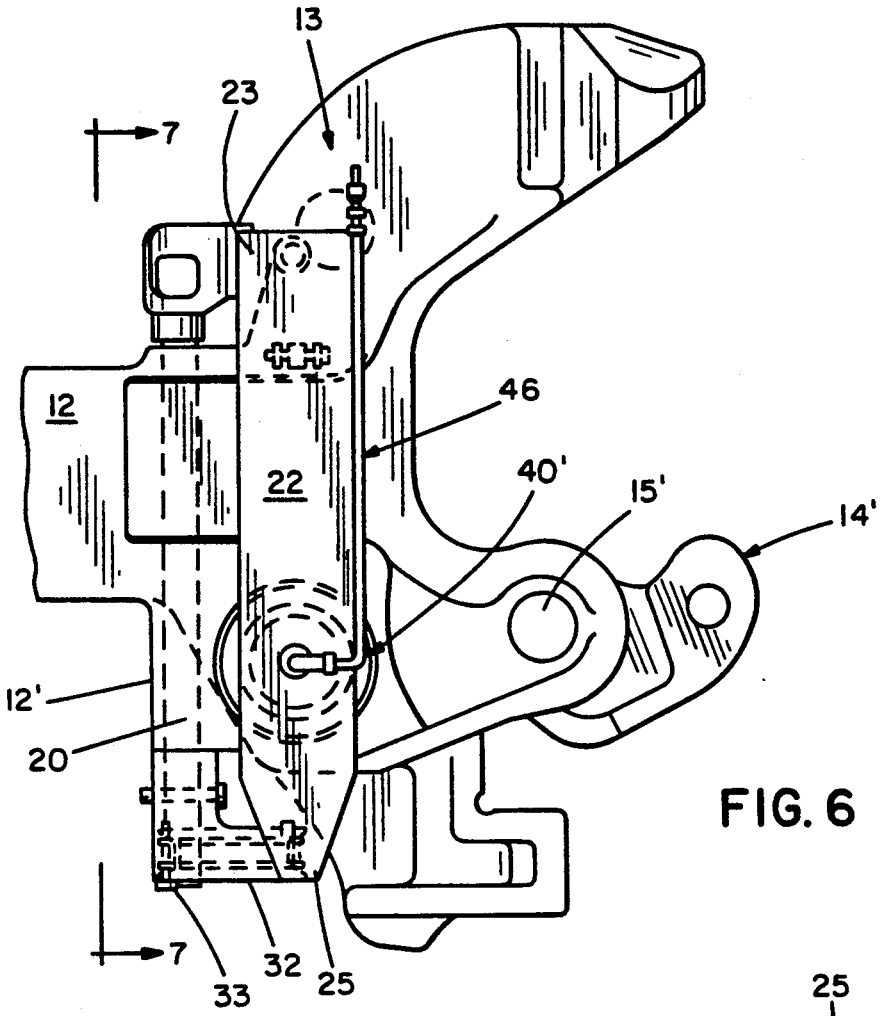
FIG. 6 is a top view showing the knuckle-assembly in its knuckle open state.
Figure 7:
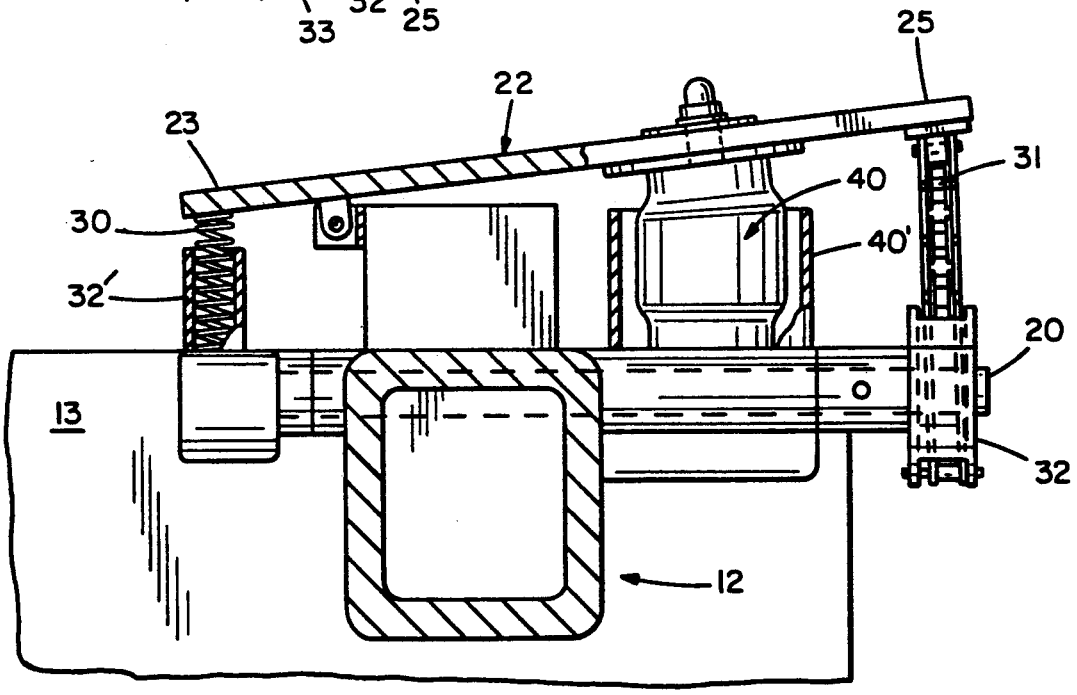
FIG. 7 is a cross-sectional view taken along line 7—7 of FIG. 6.

In the first embodiment of the linkage-actuator 18, there is provided a pivotal plate 22. The plate 22 has a length longer than the width of the top surface of the coupler head 13. The plate 22 is pivotally mounted by a horizontal pivot shaft 24, as seen in FIGS. 4 and 7, via a pair of ears 26 projecting downwardly from opposite lateral edges of the undersurface of the plate 22. The pivot shaft 24 is mounted to a portion of the surface of the coupler head 13 via bracket mount 28. The plate 22 is spring-biassed in the clockwise direction, when viewing FIG. 4, via a compression spring 30 having an upper end engaged with end 23 of the undersurface of the plate 22. The compression spring has a lower end in contact with a surface portion of the coupler head 13. A tubular housing 32' retains the spring 30 in place, whereby the plate 22 is normally urged into its horizontal position, which constitutes the unactuated state of the linkage-assembly 18, when the knuckle 14' is in its locked state shown in FIGS. 1–3, or when the knuckle 14' is in its completely pivoted-open position for coupling to another like knuckle of another passenger car. The other end 25 of the plate 22 is connected to a flexible chain-link connector 31 having an upper link end secured to the underside of the plate-end 25. The chain-link connector 31 has a lower end 31' that is affixed to a portion of an eccentric cam 32 via locking pin 33, as seen in FIGS. 5 and 7, which cam is coupled to the rotary operating rod 20 of the knuckle-assembly. As can be seen in FIGS. 1, 2 and 5, the cam 32 is provided with a cut-out channel 36 on its surface face, in which channel the approximate lower half of the length of the flexible chain-link connector 31 is received.

The pivotal plate 22 is pneumatically lifted via a conventional air bellows 40 mounted also on the upper surface of the coupler head 13. Air bellows 40 is mounted on the opposite side of the pivot rod 24 as the compression spring 30. Appropriate pneumatic piping 46 coupled to the air bellows 40 supplies the pressurized air for operating the air bellows, in a conventional manner. It may, therefore, be seen that when the air bellows 40 is actuated and extended upwardly by the compressed air supply 46, the plate-end 25 of the plate 22 is lifted vertically upwardly, as can be seen in FIG. 7. This causes the lifting of the flexible chain-link connector 31, which, in turn, causes the counter-clockwise rotation of the eccentric cam 32, and, therefore, the counterclockwise rotation of the knuckle operating rod 20. The end 25 is lifted to a sufficient height such that the rod 20 is rotated through the required angular distance in order to place the knuckle-assembly's operating parts into their lock-set position, for subsequent decoupling of two passenger cars, or to fully throw the knuckle for subsequent coupling when there is no mating car with a respective knuckle positioned in the knuckle assembly 14. The flexible chain-link coupling allows for the eccentric cam 32 to rotate by its own mass in the clockwise direction after the air bellows has been deactuated, which lowers the plate-end 25 and the plate 22 to its horizontal position, whereby the cam 32 returns to its normal position for the next actuating movement, which return movement of the cam is also aided by the subsequent closing of the knuckle during coupling. It is noted that use of the air-bellows 40 obviates the need for some kind of lost-motion or linkage connection between the upper, extensible surface of the power-lift mechanism and the portion of the pivotal plate 22 thereat, since the air-bellows is inherently flexible not only in the vertical up-and-down directions but also in the lateral directions as well. Thus, as can be seen in FIG. 7, the air-bellows, when actuated, will bend to accommodate the movement of the free end 25 of the plate 22. Surrounding the air bellows 40 is an arcuate, annular shield 40' (FIG. 7) that defines a flat, upper arcuate surface which is secured, as by welding, to the undersurface of the plate 22, whereby when the plate is in its lowered, horizontal state, it is spaced above the air bellows.

Figure 8:
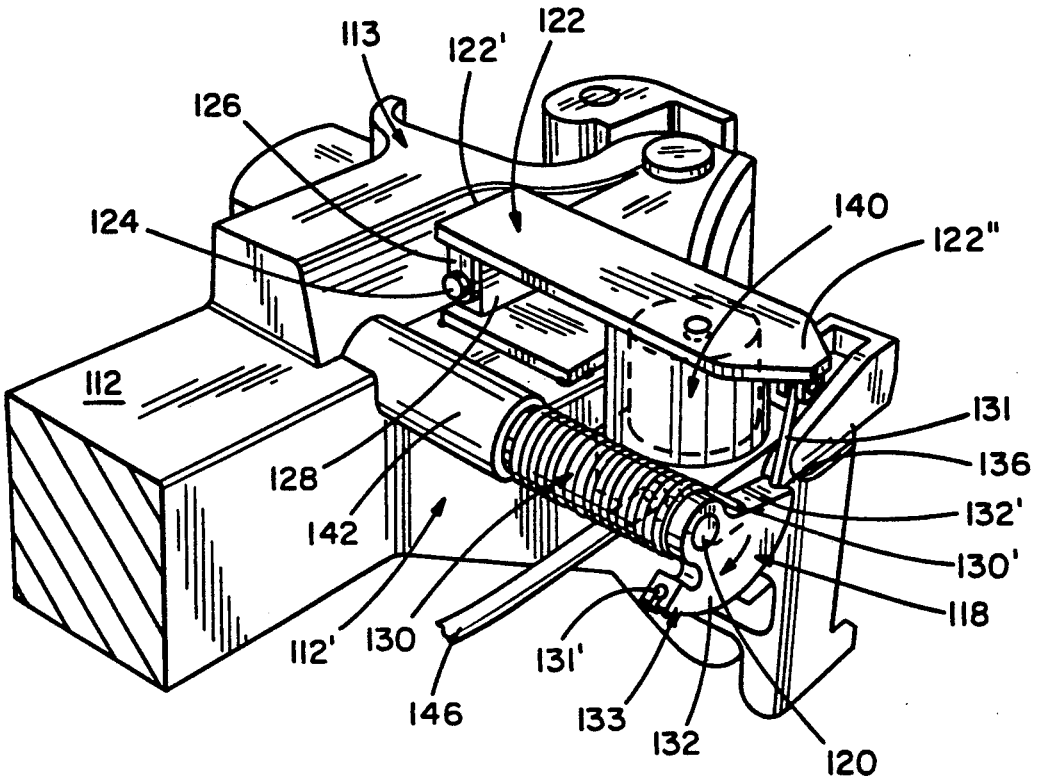
FIG. 8 is a perspective view showing the knuckle linkage-actuator for a railway passenger car according to a second embodiment of the invention.
Figure 9:
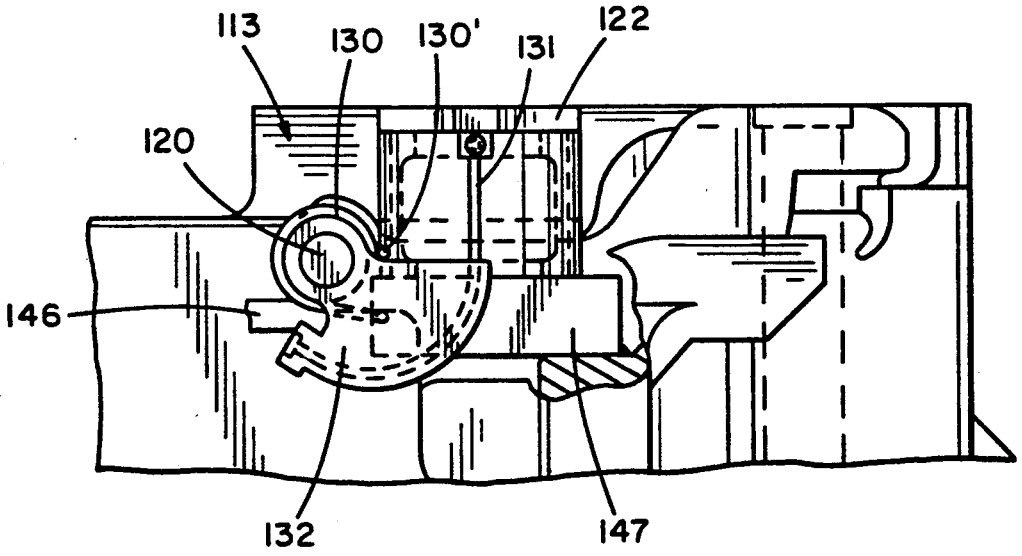
FIG. 9 is a side elevational view thereof, with the knuckle linkage-actuator being unactuated, and the knuckle-assembly in its locked state.
Figure 10:
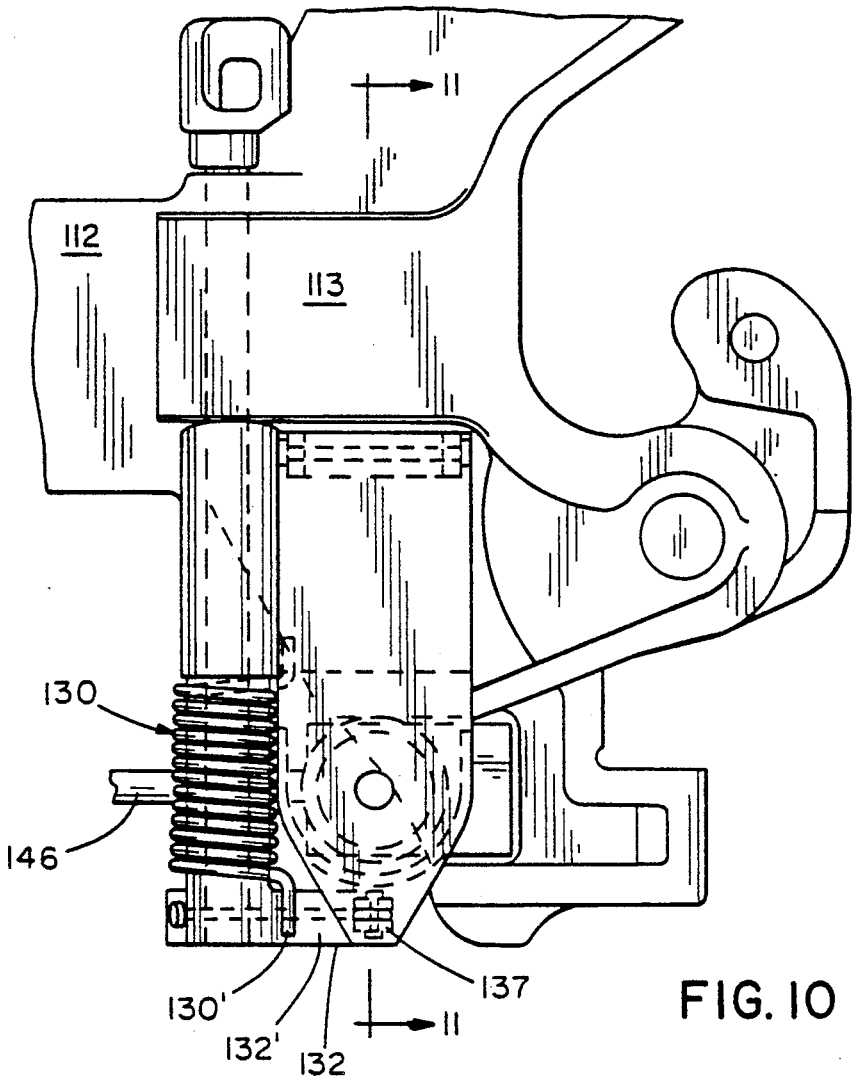
FIG. 10 is a top view thereof, with the knuckle-assembly shown in its closed, locked state.
Figure 11:
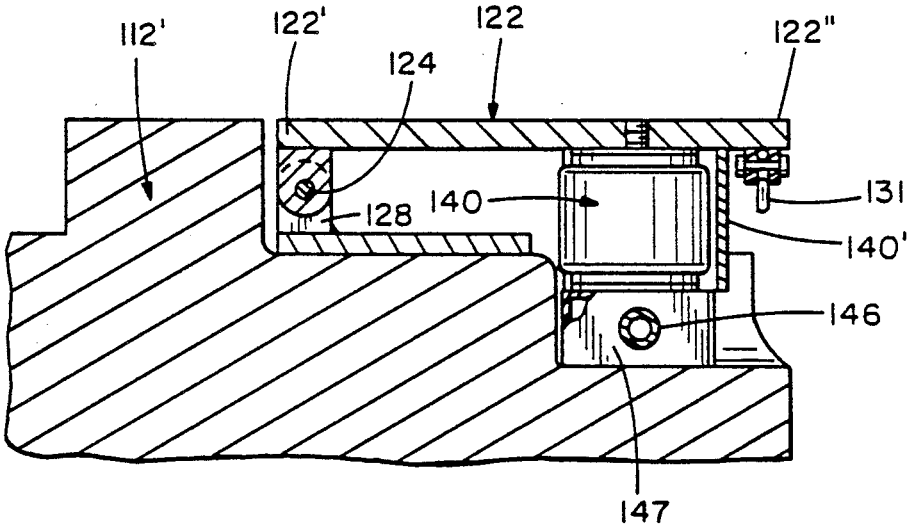
FIG. 11 is a cross-sectional view taken along line 11—11 of FIG. 10.

Referring to FIGS. 8–11, there is shown a second embodiment of the linkage-actuator for a railway passenger car of the invention. The linkage-actuator is indicated generally by reference numeral 118 and includes an eccentric cam member 132 coupled to a knuckle-assembly's rotatable operating rod 120 which, when rotated in the counter-clockwise direction, places the knuckle-assembly in its lock-set state. The linkage-actuator assembly 118 also includes a pivotal plate 122, which is shorter than the plate 22 of the first embodiment. In this embodiment, both the pivoted end 122' of the plate 122 and the free end 122" thereof are positioned on the same lateral side as the operating rod 120, on the same side of the coupler head 113, as seen in FIG. 8. The pivoted end 122' is pivotally mounted by a pivot rod 124 passing through downwardly-extending, oppositely-disposed mounting ears 126 of the plate-end 122', which rod 124 also passes through upstanding block 128 projecting upwardly from the upper surface face of the coupler head 113. This arrangement provides for considerable space-saving as well as a more cost-effective assembly, as compared to the first embodiment, which is extremely important in conjunction with the relatively wider hydraulic-cushioning shank discussed above. Conventional air-bellows 140 is also mounted on the upper surface face of a manifold block 147 on the coupler head 113, which bellows is coupled at it upper end to an undersurface of the plate end 122", for pivoting the plate and lifting the free end 122", in the same manner as described above with respect to the bellows 40 of the first embodiment. However, the air bellows 140 has its pneumatic hose-connections 146 connected to the manifold block or actuator mounting block 147 extending rearwardly, which allows for more convenient routing of the air line to the interior of the railway car, with the air-bellows 140 being pressurized through its bottom rather than its top. The underside of the free end 122" of the plate 122 is connected to an upper end of a flexible cable 131 via clamp 137, which cable, in turn, is coupled at its lower, distal end 131' to the eccentric cam 132, which distal end 131' is connected to the eccentric cam 132 via a clamp 133. The cable 131 also passes through a channel 136 formed in the outer edge surface of the cam 132, whereby the cable is partially wrapped about the eccentric cam for pulley-like mechanical advantage. A torsion spring 130 is entrained about a circular housing 140, in which housing 140 is rotatably mounted the operating rod 120. The torsion spring is mounted between a laterally-inwardly facing surface face of the eccentric cam 132 and an end of a diametrically-enlarged, laterally-inward portion 142 of the operating-rod housing 140, as seen in FIGS. 8 and 10. A clip-end 130' of the torsion spring 130 abuts against a flat edge-surface 132' of the eccentric cam 132, which, thereby, biasses the cam in the clockwise direction, when viewing FIG. 8. When air-bellows 140 is actuated, the plate-end 122" is lifted up, raising the cable-connector 131, to thereby rotate the eccentric cam in the counter-clockwise direction against the bias of the torsion spring, which rotates the operating rod 120 in that direction, to move the knuckle-assembly into its lock-set position, or fully throws the knuckle open when there is no adjoining knuckle coupled. Manual operation of the linkage-actuator 118 is accomplished by lifting up the free end 122" of the pivotal plate 122, whereby the lock-set state or fully open state may be achieved manually. It may, therefore, be seen that the entire linkage-actuator of the second embodiment is mounted on just one lateral side of the top surface of the coupler head 113, saving considerably on space and cost. Surrounding the air bellows 140 is an arcuate, annular shield 140' that defines an upper arcuate surface to which is permanently secured, as by welding, the undersurface of the plate 122, so that the shield 140' moves with the plate 122, so that, when the plate 122 is in its lowered, horizontal state, the plate 122 is spaced above the upper portion of the air bellows 140.

While specific embodiments of the invention have been shown and described, it is to be understood that numerous changes and modifications may be made therein without departing from the scope, spirit and intent of the invention as set forth in the appended claims.

What I claim is:

1. In a railway car comprising a main car frame, a coupler comprising a coupler head and a knuckle assembly for coupling the railway car to another railway car, a shank connecting the coupler to the main car frame, said shank having a distal end connected to said coupler head, and linkage-actuation means for actuating the knuckle assembly for moving the knuckle assembly into one of a lock-set position and fully open position, said coupler head having an upper surface, wherein the improvement comprises:

said linkage-actuation means being mounted on said coupler head, whereby accommodation of space constraints is possible;

said linkage-actuation means comprising a pivotal plate having a first end portion and a second end portion, means for pivotally mounting said first end portion to said coupler head, power means mounted on said coupler head between said first and second end portions for pivoting said plate about said means for pivotally mounting between a raised and lowered position; said knuckle assembly comprising a rotatable operating rod, and means coupling said second end portion of said plate to said rotatable operating rod for rotating said operating rod when said plate is pivoted by said power means, to thereby move said knuckle assembly into its lock-set and fully open positions;

said means coupling said second end portion of said plate comprising an eccentric cam connected to said operating rod for conjoint rotation therewith, and a connector connecting said second end portion of said plate to said eccentric cam, said connector having a first end affixed to a portion of said eccentric cam and a second end affixed to said second end portion of said plate, whereby when said plate is pivoted, said eccentric cam is caused to rotate to thus cause said operating rod to rotate; and spring-biassing means for urging said plate into the lowered position when said power means is not actuated.

2. The railway car according to claim 1, wherein said power means comprises an air bellows mounted on said upper surface of said coupler head and below said plate, and pneumatic-supply means for supplying pressurized air to said air bellows, said bellows having an upper extendible portion connected to an undersurface portion of said plate for lifting said second end portion of said plate.

3. The railway car according to claim 2, further comprising an annular outer shield at least partially surrounding said air bellows and having an upper edge surface connected to a portion of said plate, so that, when said plate is in the lowered position, said annular outer shield spaces said plate above the upper portion of said air bellows.

4. The railway car according to claim 1, wherein said spring-biassing means comprises a compression spring having a first lower end on said coupler head, and a second upper end in abutment against a portion of the undersurface of said first end portion of said plate, said portion of the undersurface of said first end portion of said plate being disposed on the opposite lateral side of said means for pivotally mounting as said second end portion of said plate, whereby said spring biases said plate in a direction opposite to the direction that said power means rotates said plate when said power means is actuated.

5. The railway car according to claim 4, wherein said means for pivotally mounting is mounted to said coupler head on a portion thereof laterally opposite to the portion to which said air bellows is mounted.

6. The railway car according to claim 1, wherein said eccentric cam comprises a curved outer edge surface, and a channel formed in said curved outer edge surface, said first end of said connector being affixed to a portion of said outer edge surface of said eccentric cam, said connector comprising a lower section originating at said first end of said connector that is received within said channel.

7. The railway car according to claim 6, wherein said connector comprises one of a chain-link connector and a cable.

8. The railway car according to claim 1, wherein said spring-biassing means comprises a torsion spring; said coupler head comprising a housing for said operating rod of said knuckle assembly, said housing extending from said eccentric cam and having a larger-diameter portion spaced from said eccentric cam and defining an annular rim spaced from said eccentric cam; said torsion spring being telescopingly mounted about said housing between said eccentric cam and said annular rim; said torsion spring having an end in operative engagement with said eccentric cam for biassing said eccentric cam in a direction opposite to the direction that said power means rotates said plate when said power means is actuated, whereby said torsion spring urges said plate into the lowered position when said power means is not actuated.

9. The railway car according to claim 8, wherein said first end portion and said second end portion of said plate are mounted on the same lateral side of said coupler head.

10. The railway car according to claim 1, wherein said shank is a hydraulic-cushioning shank.

11. A linkage-actuator assembly for a railway car coupler knuckle assembly for actuating a knuckle assembly of the railway car for moving the knuckle assembly into one of a lock-set position and fully open position, comprising:

a pivotal plate having a first end portion and a second end portion, means for pivotally mounting said first end portion to a coupler head of a railway car, power means for pivoting said plate about said means for pivotally mounting between a raised and lowered position; and means coupling said second end portion of said plate to a rotatable operating rod of a knuckle-assembly for rotating the operating rod when said plate is pivoted by said power means;

said means coupling said second end portion comprising an eccentric cam connectable to an operating rod for conjoint rotation therewith, and a connector connecting said second end portion of said plate to said eccentric cam, said connector having a first end affixed to a portion of said eccentric cam and a second end affixed to said second end portion of said plate, whereby when said plate is pivoted, said eccentric cam is caused to rotate to thus cause said operating rod to rotate; and spring-biassing means for urging said plate into the lowered position when said power means is not actuated;

said eccentric cam comprising a curved outer edge surface, and a channel formed in said curved outer edge surface, said first end of said connector being affixed to a portion of said outer edge surface of said eccentric cam, said connector comprising a lower section originating at said first end of said connector that is received within said channel.

12. The linkage-actuator assembly for a railway car coupler knuckle assembly according to claim 11, wherein said power means comprises an air bellows, and pneumatic-supply means for supplying pressurized air to said air bellows, said air bellows having an upper extensible portion connected to an undersurface portion of said plate for lifting and lowering said second end portion of said plate.

13. The linkage-actuator assembly for a railway car coupler knuckle assembly according to claim 12, further comprising an annular outer shield at least partially surrounding said air bellows and having an upper edge surface secured to a portion of said plate, so that when said plate is in the lowered position, said annular outer shield elevates said plate above the upper portion of said air bellows.

14. The linkage-actuator assembly for a railway car coupler knuckle assembly according to claim 11, wherein said connector comprises one of a chain-link connector and a cable.

15. The linkage-actuator assembly for a railway car coupler knuckle assembly according to claim 11, wherein said spring-biassing means is a torsion spring; said torsion spring having an end in operative engagement with said eccentric cam for biassing said eccentric cam in a direction opposite to the direction that said power means rotates said plate when said power means is actuated, whereby said torsion spring urges said plate into the lowered position when said power means is not actuated.

16. A linkage-actuator assembly for a railway car coupler knuckle assembly for actuating a knuckle assembly of the railway car for moving the knuckle assembly into one of a lockset position and fully open position, comprising:

a pivotal plate having a first end portion and a second end portion, means for pivotally mounting said first end portion to a coupler head of a railway car, power means for pivoting said plate about said means for pivotally mounting between a raised and lowered position; and means coupling said second end portion of said plate to a rotatable operating rod of a knuckle-assembly for rotating the operating rod when said plate is pivoted by said power means;

said power means comprising an air bellows, and pneumatic-supply means for supplying pressurized air to said air bellows, said air bellows having an upper extensible portion connected to an undersurface portion of said plate for lifting and lowering said second end portion of said plate; and an annular outer shield at least partially surrounding said air bellows and having an upper edge surface secured to a portion of said plate, so that, when said plate is in the lowered position, said annular outer shield elevates said plate above the upper portion of said air bellows.

* * * * *